US010716352B2

(12) United States Patent
Knight

(10) Patent No.: US 10,716,352 B2
(45) Date of Patent: Jul. 21, 2020

(54) VISUAL AND AUDIO INDICATOR OF SHEAR IMPACT FORCE ON PROTECTIVE GEAR

(71) Applicant: Brainguard Technologies, Inc., Richmond, CA (US)

(72) Inventor: Robert T. Knight, Berkeley, CA (US)

(73) Assignee: Brainguard Technologies, Inc., El Cerrito, CA (US)

( * ) Notice: Subject to any disclaimer, the term of this patent is extended or adjusted under 35 U.S.C. 154(b) by 223 days.

(21) Appl. No.: 15/784,486

(22) Filed: Oct. 16, 2017

(65) Prior Publication Data

US 2018/0035740 A1 Feb. 8, 2018

Related U.S. Application Data

(63) Continuation-in-part of application No. 15/631,713, filed on Jun. 23, 2017, now abandoned, which is a (Continued)

(51) Int. Cl.
*A42B 3/06* (2006.01)
*A42B 3/22* (2006.01)
(Continued)

(52) U.S. Cl.
CPC ..... *A42B 3/064* (2013.01); *A41D 13/015* (2013.01); *A42B 3/04* (2013.01); *A42B 3/046* (2013.01);
(Continued)

(58) Field of Classification Search
CPC ..... A42B 3/067; A42B 3/064; A42B 3/0453; A42B 3/125
See application file for complete search history.

(56) References Cited

U.S. PATENT DOCUMENTS 3,946,441 A 3/1976 Johnson
4,352,484 A 10/1982 Gertz et al.
(Continued)

FOREIGN PATENT DOCUMENTS

DE 102011086791 A1 5/2013
EP 2734071 5/2014
(Continued)

OTHER PUBLICATIONS

"U.S. Appl. No. 15/631,713, Non Final Office Action dated Oct. 20, 2017", 7 pages.
(Continued)

*Primary Examiner* — Tajash D Patel
(74) *Attorney, Agent, or Firm* — Kwan & Olynick LLP

(57) ABSTRACT

A helmet detects shear force impacts. Indicator elements in the helmet or protective gear provides a visual indication, an audio indication, or a combination is contained in the surface of the outer shell of the helmet and detects when there is a mechanical force imparted on the helmet. One or more sensors are embedded in the helmet and detect when a shear force is imparted on the helmet. In other embodiments, the sensors can detect that there was a mechanical force on the helmet and also measure the energy of the force. The outer surface of the helmet may have a lining that changes appearance with a shear impact force hits the surface of the helmet.

21 Claims, 8 Drawing Sheets

Related U.S. Application Data continuation of application No. 15/202,173, filed on Jul. 5, 2016, now Pat. No. 9,723,889, which is a continuation of application No. 15/050,357, filed on Feb. 22, 2016, now Pat. No. 9,516,909, which is a continuation of application No. 14/927,093, filed on Oct. 29, 2015, now Pat. No. 9,289,022, which is a continuation of application No. 14/809,142, filed on Jul. 24, 2015, now Pat. No. 9,414,635, which is a continuation of application No. 14/714,093, filed on May 15, 2015, now Pat. No. 9,271,536, which is a continuation of application No. 14/485,993, filed on Sep. 15, 2014, now Pat. No. 9,060,561, which is a continuation of application No. 13/554,471, filed on Jul. 20, 2012, now Pat. No. 8,863,319.

(60) Provisional application No. 61/510,401, filed on Jul. 21, 2011.

(51) Int. Cl.

| | |
|---|---|
| ***A42B 3/20*** | (2006.01) |
| ***A42B 3/14*** | (2006.01) |
| ***A42B 3/08*** | (2006.01) |
| ***A42B 3/12*** | (2006.01) |
| ***A41D 13/015*** | (2006.01) |
| ***A42B 3/04*** | (2006.01) |
| *A41D 31/28* | (2019.01) |

(52) U.S. Cl.

CPC ..... *A42B 3/063* (2013.01); *A42B 3/067* (2013.01); *A42B 3/08* (2013.01); *A42B 3/12* (2013.01); *A42B 3/121* (2013.01); *A42B 3/125* (2013.01); *A42B 3/14* (2013.01); *A42B 3/20* (2013.01); *A42B 3/22* (2013.01); *A41D 31/285* (2019.02)

(56) References Cited

U.S. PATENT DOCUMENTS

| | | | | |
|---|---|---|---|---|
| 5,713,082 | A | 2/1998 | Bassette et al. | |
| 5,815,846 | A | 10/1998 | Calonge | |
| 5,956,777 | A | 9/1999 | Popovich | |
| 6,103,641 | A | 8/2000 | Gehring, Jr. | |
| 6,145,348 | A | 11/2000 | Hardegree et al. | |
| 6,378,140 | B1 | 4/2002 | Abraham et al. | |
| 6,434,755 | B1 | 8/2002 | Halstead et al. | |
| 6,658,671 | B1 | 12/2003 | Von Holst et al. | |
| 6,728,969 | B2 | 5/2004 | Zeiler | |
| 6,996,856 | B2 | 2/2006 | Puchalski | |
| 7,076,811 | B2 | 7/2006 | Puchalski | |
| 7,254,843 | B2 | 8/2007 | Talluri | |
| 7,509,835 | B2 * | 3/2009 | Beck | A42B 3/046 2/425 |
| 8,104,593 | B2 | 1/2012 | Lin | |
| 8,176,574 | B2 | 5/2012 | Bryant et al. | |
| 8,533,869 | B1 | 9/2013 | Capuano | |
| 8,863,319 | B2 | 10/2014 | Knight | |
| 9,060,561 | B2 | 6/2015 | Knight | |
| 9,271,536 | B2 | 3/2016 | Knight | |
| 9,289,022 | B2 | 3/2016 | Knight | |
| 9,414,635 | B2 | 8/2016 | Knight | |
| 9,516,909 | B2 | 12/2016 | Knight | |
| 9,521,874 | B2 | 12/2016 | Knight | |
| 9,622,531 | B1 * | 4/2017 | Crispino | A42B 3/067 |
| 9,723,889 | B2 | 8/2017 | Knight | |
| 9,750,296 | B2 | 9/2017 | Knight | |
| 2003/0088906 | A1 | 5/2003 | Baker | |
| 2004/0126565 | A1 | 7/2004 | Naganathan et al. | |
| 2006/0038694 | A1 * | 2/2006 | Naunheim | A42B 3/046 340/665 |
| 2006/0059605 | A1 | 3/2006 | Ferrara | |
| 2008/0066217 | A1 | 3/2008 | Depreitere et al. | |
| 2011/0004980 | A1 | 1/2011 | Leatt et al. | |
| 2013/0019384 | A1 | 1/2013 | Knight | |
| 2013/0185837 | A1 * | 7/2013 | Phipps | A42B 3/12 2/2.5 |
| 2013/0239397 | A1 | 9/2013 | Hotte | |
| 2014/0208486 | A1 * | 7/2014 | Krueger | A42B 3/064 2/414 |
| 2015/0000014 | A1 | 1/2015 | Knight | |
| 2015/0238143 | A1 * | 8/2015 | Meurer | A61B 5/6803 600/595 |
| 2015/0245681 | A1 | 9/2015 | Knight | |
| 2016/0044983 | A1 | 2/2016 | Knight | |
| 2016/0081416 | A1 | 3/2016 | Knight | |
| 2016/0157545 | A1 * | 6/2016 | Bowman | A42B 3/067 2/416 |
| 2016/0165994 | A1 | 6/2016 | Knight | |
| 2016/0165995 | A1 | 6/2016 | Knight | |
| 2016/0302507 | A1 | 10/2016 | Lewis et al. | |
| 2016/0309828 | A1 | 10/2016 | Knight | |
| 2017/0055621 | A1 | 3/2017 | Knight et al. | |
| 2017/0280809 | A1 | 10/2017 | Knight | |
| 2017/0303623 | A1 * | 10/2017 | Sicking | A42B 3/064 |
| 2019/0116907 | A1 * | 4/2019 | Grice | A42B 3/06 |

FOREIGN PATENT DOCUMENTS

| | | | |
|---|---|---|---|
| SE | 1050905 | A1 | 7/2011 |
| WO | 0145526 | A1 | 6/2001 |
| WO | 2004032659 | A1 | 4/2004 |
| WO | 2011087435 | A1 | 7/2011 |
| WO | 2012109381 | A1 | 8/2012 |
| WO | 2013013180 | A1 | 1/2013 |

OTHER PUBLICATIONS

"European Application Serial No. 17176834.4, Search Report dated Dec. 20, 2017", 8 pgs.

"European Application Serial No. 17176839.3, Search Report dated Dec. 20, 2017", 8 pgs.

"6D Helmets—Omni-Directional Suspension (ODS)", Retrieved from the Internet: <http://www.6dhelmets.com/#!ods/c10b6>, Accessed on Nov. 16, 2015.

"U.S. Appl. No. 14/809,142, Notice of Allowance dated Feb. 17, 2016", 5 pgs.

"U.S. Appl. No. 13/554,471, Non Final Office Action dated May 22, 2014", 5 pgs.

"U.S. Appl. No. 13/554,471, Notice of Allowance dated Jul. 15, 2014", 5 pgs.

"U.S. Appl. No. 14/485,993, Non Final Office Action dated Oct. 28, 2014", 6 pgs.

"U.S. Appl. No. 14/485,993, Notice of Allowance dated Mar. 19, 2015", 5 pgs.

"U.S. Appl. No. 14/714,093, Non Final Office Action dated Aug. 14, 2015", 7 pgs.

"U.S. Appl. No. 14/714,093, Notice of Allowance dated Dec. 31, 2015", 5 pgs.

"U.S. Appl. No. 14/809,142, Non Final Office Action dated Dec. 17, 2015", 6 pgs.

"U.S. Appl. No. 14/927,093, Non Final Office Action dated Dec. 18, 2015", 6 pgs.

"U.S. Appl. No. 14/927,093, Notice of Allowance dated Feb. 11, 2016", 6 pgs.

"U.S. Appl. No. 15/050,357, Non Final Office Action dated Mar. 29, 2016", 7 pgs.

"U.S. Appl. No. 15/050,357, Notice of Allowance dated Aug. 5, 2016", 5 pages.

"U.S. Appl. No. 15/050,373, Non Final Office Action dated Mar. 29, 2016", 7 pgs.

"U.S. Appl. No. 15/050,373, Notice of Allowance dated Aug. 10, 2016", 5 pages.

"U.S. Appl. No. 15/202,173, Examiner Interview Summary dated Apr. 10, 2017".

(56) References Cited

OTHER PUBLICATIONS

"U.S. Appl. No. 15/202,173, Non Final Office Action dated Sep. 22, 2016", 7 pages.
"U.S. Appl. No. 15/202,173, Notice of Allowance dated Apr. 10, 2017", 5 pgs.
"U.S. Appl. No. 15/348,757, Examiner Interview Summary dated May 30, 2017", 3 pages.
"U.S. Appl. No. 15/348,757, Non Final Office Action dated Dec. 22, 2016", 8 pages.
"U.S. Appl. No. 15/348,757, Notice of Allowance dated Jul. 18, 2017", 5 pgs.
"European Application Serial No. 12814787.3, Search Report and Opinion dated Mar. 30, 2015", 6 pgs.
"Helmet with Fluid Layer that Protects Against a Common Cause of Head Injury", Office of Technology Licensing, University of Florida, [Online]. Retrieved from the Internet: < http://apps.research.ufl.edu/otl/pdf/marketing/13586.pdf > Accessed on Jul. 12, 2012.
"International Application Serial No. PCT/US2012/047662, Written Opinion dated Oct. 5, 2012".
"International Application Serial No. PCTUS2012/047662, Search Report and Written Opinion dated Oct. 5, 2012".
"Int'l Application Serial No. PCT/US2012/047662, Preliminary Report on Patentability dated Jan. 30, 2014", 7 pgs.
"Lazer Helmets", [Online]. Retrieved from the Internet: < http://www.lazerhelmets.com/wp-content/uploads/2011/04/Catalogue-Motorcycling-2010-UK.pdf >, Jul. 2, 1905 00:00:00.0.
"Materials for Bicycle Helmets", Granta Design, Retrieved from the Internet: http://www.grantadesign.com/resources/materials/casestudies/helmet.htm, Accessed on Oct. 22, 2015, 2015, 5 pgs.
"Proposal for a Novel Helmet Design", Brainguard Technologies.
"The Helmet that Might Save Football", 1 pg.
"University expands sports concussion-risk studies to include hockey and", Office of University Relations, Virginia Tech, 2013, 3 pgs.
Bosch, Henricus V. , "Crash Helmet Testing and Design Specifications", University Press Facilities, Eindhoven, the Netherlands, Jun. 28, 1905 00:00:00.0.
Collins, Micky , "Examining Concussion Rates and Return to Play in High School Football Players Wearing Newer Helmet Technology: A Three-Year Prospective Cohort Study", Neurosurgery, vol. 58, No. 2, Feb. 1, 2006 00:00:00.0.
Goel, R , "Design of an Advanced Helmet Liner User Simulations", [Online]. Retrieved from the Internet: < http://mvl.mit.edu/MVLpubs/MVL_10.07_Goel.pdf > Accessed on /13/12.
May, Philip R. , "Woodpecker Drilling Behavior: An Endorsement of the Rotational Theory of Impact Brain Injury", Arch Neural, vol. 36,, Jun. 1, 1979 00:00:00.0.
Mohney, Gillian , "First Soccer Player Diagnosed with CTE Brings up Sports Risks", Retrieved from the Internet: https://gma.yahoo.com/first-soccer-player-diagnosed-cte-brings-sports-risks-211805546.html , Accessed on Oct. 22, 2015, 2014, 8 pgs.
Rowson, Steven et al., "Brain Injury Prediction: Assessing the Combined Probability of Concussion Using Linear and Rotational Head Acceleration", Annals of Biomedical Engineering, vol. 41, No. 5, May 2013, pp. 873-882.
Viano, David C. , "Concussion in Professional Football: Brain Responses by Finite Element Analysis: Part 9", Neurosurgery, vol. 57, No. 5, Nov. 1, 2005 00:00:00.0.
Wang, Lizhen , "Why do Woodpeckers Resist Head Impact Injury: A Biomechanical Investigation", PLos One, vol. 6, No. 10, Oct. 1, 2011 00:00:00.0.

* cited by examiner

VISUAL AND AUDIO INDICATOR OF SHEAR IMPACT FORCE ON PROTECTIVE GEAR

CROSS-REFERENCE TO RELATED APPLICATIONS

This application is a continuation-in-part of and claims benefit under 35 U.S.C. § 120 to U.S. application Ser. No. 15/631,713, entitled BIOMECHANICS AWARE HEADGEAR, filed Jun. 23, 2017, which is a continuation of and claims benefit under 35 U.S.C. § 120 to U.S. application Ser. No. 15/202,173, entitled BIOMECHANICS AWARE HEADGEAR, filed Jul. 5, 2016, now issued as U.S. Pat. No. 9,723,889 on Aug. 8, 2017, which is a continuation of and claims benefit under 35 U.S.C. § 120 to U.S. application Ser. No. 15/050,373, entitled BIOMECHANICS AWARE HEADGEAR, filed Feb. 22, 2016, now issued as U.S. Pat. No. 9,521,874 on Dec. 20, 2016, and to U.S. application Ser. No. 15/050,357, entitled BIOMECHANICS AWARE HELMET, filed Feb. 22, 2016, now issued as U.S. Pat. No. 9,516,909 on Dec. 13, 2016, which are continuations of and claims benefit under 35 U.S.C. § 120 to U.S. application Ser. No. 14/927,093, entitled BIOMECHANICS AWARE HELMET, filed Oct. 29, 2015, now issued as U.S. Pat. No. 9,289,022 on Mar. 22, 2016, which is a continuation of and claims benefit under 35 U.S.C. § 120 to U.S. application Ser. No. 14/809,142, entitled BIOMECHANICS AWARE HELMET, filed Jul. 24, 2015, now issued as U.S. Pat. No. 9,414,635 on Aug. 16, 2016, which is a continuation of and claims benefit under 35 U.S.C. § 120 to U.S. application Ser. No. 14/714,093, entitled BIOMECHANICS AWARE PROTECTIVE GEAR, filed May 15, 2015, now issued as U.S. Pat. No. 9,271,536 on Mar. 1, 2016, which is a continuation of and claims benefit under 35 U.S.C. § 120 to U.S. application Ser. No. 14/485,993, entitled BIOMECHANICS AWARE HELMET, filed Sep. 15, 2014, now issued as U.S. Pat. No. 9,060,561 on Jun. 23, 2015, which is a continuation of and claims benefit under 35 U.S.C. § 120 to U.S. application Ser. No. 13/554,471, entitled BIOMECHANICS AWARE PROTECTIVE GEAR, filed Jul. 20, 2012, now issued as U.S. Pat. No. 8,863,319 on Oct. 21, 2014, which claims priority to U.S. Provisional Patent Application No. 61/510,401, entitled SMART BIOMECHANICS AWARE ENERGY CONSCIOUS PROTECTIVE GEAR WITH TISSUE PROTECTION, filed on Jul. 21, 2011, all of which are incorporated herein by reference for all purposes.

TECHNICAL FIELD

The present disclosure relates to helmets and protective gear containing sensors for detecting shear force impacts on the helmet and indicators, such as lights and audio, that are activated when there is a shear or other type of mechanical impact.

DESCRIPTION OF RELATED ART

Protective gear such as sports and safety helmets are designed to reduce direct impact forces that can mechanically damage an area of contact. Protective gear will typically include padding and a protective shell to reduce the risk of physical head injury. Liners are provided beneath a hardened exterior shell to reduce violent deceleration of the head in a smooth uniform manner and in an extremely short distance, as liner thickness is typically limited based on helmet size considerations.

Protective gear is reasonably effective in preventing injury. Nonetheless, the effectiveness of protective gear remains limited. Consequently, various mechanisms are provided to improve movement of shell layers in helmets and other protective gear during the application of impact forces. Also provided are sensors in the helmet that are able to sense shear impact to the helmet and indicators that indicate when such an impact occurs.

BRIEF DESCRIPTION OF THE DRAWINGS

The disclosure may best be understood by reference to the following description taken in conjunction with the accompanying drawings, which illustrate particular embodiments.

SUMMARY OF THE INVENTION

Figure 1:
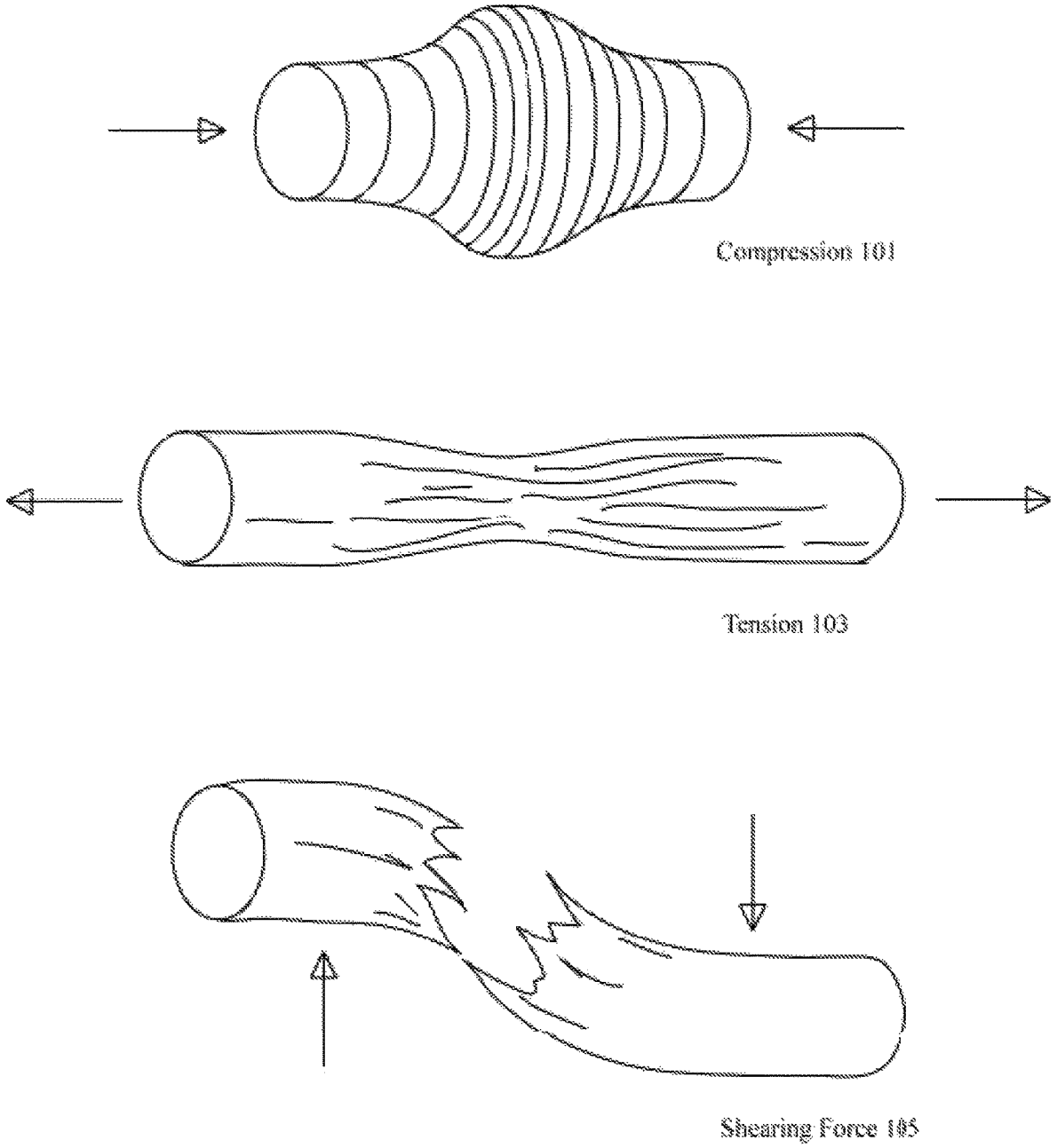
FIG. 1 illustrates types of forces on axonal fibers.

In one aspect of the invention, a helmet or other protective gear has a first protective layer and a second protective layer. The second protective layer is connected to the first protective layer by an energy and impact transformer layer operable to absorb energy from shear forces imparted on the first protective layer and wherein the first protective layer is able to slide relative to the second protective layer. The helmet also includes a shear force sensor for detecting a shear impact or other mechanical impact on the first protective layer. A shear force indicator component is in communication with the sensor, wherein the indicator component is activated when the shear force sensor detects an impact.

In another aspect of the invention, a helmet comprising has a first protective layer having an outside surface and an inside surface. There is a second protective layer connected to the first layer by an energy transformer layer. The transformer layer allows the first protective layer to slide relative to the second protective layer. An impact sensing material having a first visual appearance is on the outside surface of the first protective layer wherein the impact sensing material changes to a second visual appearance when impacted by a shear force striking the helmet. The impact sensing material may change appearance at and around the point of impact on the helmet or the entire surface may change appearance.

DESCRIPTION OF EMBODIMENTS

Reference will now be made in detail to some specific examples of the invention including the best modes contemplated by the inventors for carrying out the invention. Examples of these specific embodiments are illustrated in the accompanying drawings. While the invention is described in conjunction with these specific embodiments, it will be understood that it is not intended to limit the invention to the described embodiments. On the contrary, it is intended to cover alternatives, modifications, and equivalents as may be included within the spirit and scope of the invention as defined by the appended claims.

For example, the techniques of the present invention will be described in the context of helmets. However, it should be noted that the techniques of the present invention apply to a wide variety of different pieces of protective gear. In the following description, numerous specific details are set forth in order to provide a thorough understanding of the present invention. Particular example embodiments of the present invention may be implemented without some or all of these specific details. In other instances, well known process operations have not been described in detail in order not to unnecessarily obscure the present invention.

Various techniques and mechanisms of the present invention will sometimes be described in singular form for clarity. However, it should be noted that some embodiments include multiple iterations of a technique or multiple instantiations of a mechanism unless noted otherwise. For example, a protective device may use a single strap in a variety of contexts. However, it will be appreciated that a system can use multiple straps while remaining within the scope of the present invention unless otherwise noted. Furthermore, the techniques and mechanisms of the present invention will sometimes describe a connection between two entities. It should be noted that a connection between two entities does not necessarily mean a direct, unimpeded connection, as a variety of other entities may reside between the two entities. For example, different layers may be connected using a variety of materials. Consequently, a connection does not necessarily mean a direct, unimpeded connection unless otherwise noted.

OVERVIEW

Protective gear such as a helmet includes multiple shell layers connected using one or more concertinaed structures. The concertinaed structures allow the shell layers greater flexibility to move relative to each other when mechanical forces are imparted onto the outer shell layer. When energy and impact transformer layers are disposed between the shell layers, the concertinaed structures may also allow improvement function of the energy and impact transformer layers.

EXAMPLE EMBODIMENTS

Protective gear such as knee pads, shoulder pads, and helmets are typically designed to prevent direct impact injuries or trauma. For example, many pieces of protective gear reduce full impact forces that can structurally damage an area of contact such as the skull or knee. Major emphasis is placed on reducing the likelihood of cracking or breaking of bone. However, the larger issue is preventing the tissue and neurological damage caused by rotational forces, shear forces, oscillations, and tension/compression forces.

For head injuries, the major issue is neurological damage caused by oscillations of the brain in the cranial vault resulting in coup-contracoup injuries manifested as direct contusions to the central nervous system (CNS), shear injuries exacerbated by rotational, tension, compression, and/or shear forces resulting in demyelination and tearing of axonal fibers; and subdural or epidural hematomas. Because of the emphasis in reducing the likelihood of cracking or breaking bone, many pieces of protective gear do not sufficiently dampen, transform, dissipate, and/or distribute the rotational, tension, compression, and/or shear forces, but rather focus on absorbing the direct impact forces over a small area, potentially exacerbating the secondary forces on the CNS. Initial mechanical damage results in a secondary cascade of tissue and cellular damage due to increased glutamate release or other trauma induced molecular cascades.

Traumatic brain injury (TBI) has immense personal, societal and economic impact. The Center for Disease Control and Prevention documented 1.4 million cases of TBI in the USA in 2007. This number was based on patients with a loss of consciousness from a TBI resulting in an Emergency Room visit. With increasing public awareness of TBI this number increased to 1.7 million cases in 2010. Of these cases there were 52,000 deaths and 275,000 hospitalizations, with the remaining 1.35 million cases released from the ER. Of these 1.35 million discharged cases at least 150,000 people will have significant residual cognitive and behavioral problems at 1-year post discharge from the ER. Notably, the CDC believes these numbers under represent the problem since many patients do not seek medical evaluation for brief loss of consciousness due to a TBI. These USA numbers are similar to those observed in other developed countries and are likely higher in third-world countries with poorer vehicle and head impact protection. To put the problem in a clearer perspective, the World Health Organization (WHO) anticipates that TBI will become a leading cause of death and disability in the world by the year 2020.

The CDC numbers do not include head injuries from military actions. Traumatic brain injury is widely cited as the "signature injury" of Operation Enduring Freedom and Operation Iraqi Freedom. The nature of warfare conducted in Iraq and Afghanistan is different from that of previous wars and advances in protective gear including helmets as well as improved medical response times allow soldiers to survive events such as head wounds and blast exposures that previously would have proven fatal. The introduction of the Kevlar helmet has drastically reduced field deaths from bullet and shrapnel wounds to the head. However, this increase in survival is paralleled by a dramatic increase in residual brain injury from compression and rotational forces to the brain in TBI survivors. Similar to that observed in the civilian population the residual effects of military deployment related TBI are neurobehavioral symptoms such as cognitive deficits and emotional and somatic complaints. The statistics provided by the military cite an incidence of 6.2% of head injuries in combat zone veterans. One might expect these numbers to hold in other countries.

In addition to the incidence of TBI in civilians from falls and vehicular accidents or military personnel in combat there is increasing awareness that sports-related repetitive forces applied to the head with or without true loss of consciousness can have dire long-term consequences. It has been known since the 1920's that boxing is associated with devastating long-term issues including "dementia pugilistica" and Parkinson-like symptoms (i.e. Mohammed Ali). We now know that this repetitive force on the brain dysfunction extends to many other sports. Football leads the way in concussions with loss of consciousness and post-traumatic memory loss (63% of all concussions in all sports), wrestling comes in second at 10% and soccer has risen to 6% of all sports related TBIs. In the USA 63,000 high school students suffer a TBI per year and many of these students have persistent long-term cognitive and behavioral issues. This disturbing pattern extends to professional sports where impact forces to the body and head are even higher due to the progressive increase in weight and speed of professional athletes. Football has dominated the national discourse in the area but serious and progressive long-term neurological issues are also seen in hockey and soccer players and in any sport with the likelihood of a TBI. Repetitive head injuries result in progressive neurological deterioration with neuropathological findings mimicking Alzheimer's disease. This syndrome with characteristic post-mortem neuropathological findings on increases in Tau proteins and amyloid plaques is referred to as Chronic Traumatic Encephalopathy (CTE).

The human brain is a relatively delicate organ weighing about 3 pounds and having a consistency a little denser than gelatin and close to that of the liver. From an evolutionary perspective, the brain and the protective skull were not designed to withstand significant external forces. Because of this poor impact resistance design, external forces transmitted through the skull to the brain that is composed of over 100 billion cells and up to a trillion connecting fibers results in major neurological problems. These injuries include contusions that directly destroy brain cells and tear the critical connecting fibers necessary to transmit information between brain cells.

Contusion injuries are simply bleeding into the substance of the brain due to direct contact between the brain and the bony ridges of the inside of the skull. Unfortunately, the brain cannot tolerate blood products and the presence of blood kicks off a biological cascade that further damages the brain. Contusions are due to the brain oscillating inside the skull when an external force is applied. These oscillations can include up to three cycles back and forth in the cranial vault and are referred to as coup-contra coup injuries. The coup part of the process is the point of contact of the brain with the skull and the contra-coup is the next point of contact when the brain oscillates and strikes the opposite part of the inside of the skull.

The inside of the skull has a series of sharp bony ridges in the front of the skull and when the brain is banged against these ridges it is mechanically torn resulting in a contusion. These contusion injuries are typically in the front of the brain damaging key regions involved in cognitive and emotional control.

Shear injuries involve tearing of axonal fibers. The brain and its axonal fibers are extremely sensitive to rotational forces. Boxers can withstand hundreds of punches directly in the face but a single round-house punch or upper cut where the force comes in from the side or bottom of the jaw will cause acute rotation of the skull and brain and typically a knock-out. If the rotational forces are severe enough, the result is tearing of axons.

FIG. 1 below shows how different forces affect axons. Compression 101 and tension 103 can remove the protective coating on an axon referred to as a myelin sheath. The myelin can be viewed as the rubber coating on a wire. If the internal wire of the axon is not cut the myelin can re-grow and re-coat the "wire" which can resume axonal function and brain communication. If rotational forces are significant, shear forces 105 tear the axon. This elevates the problem since the ends of cut axons do not re-attach. This results in a permanent neurological deficit and is referred to as diffuse axonal injury (DAD, a major cause of long-term neurological disability after TBI.

Some more modern pieces of protective gear have been introduced with the awareness that significant injuries besides musculoskeletal or flesh injuries in a variety of activities require new protective gear designs.

U.S. Pat. No. 7,076,811 issued to Puchalski describes a helmet with an impact absorbing crumple or shear zone. "The shell consists of three (or more) discrete panels that are physically and firmly coupled together providing rigid protection under most circumstances, but upon impact the panels move relative to one another, but not relative to the user's head, thereby permitting impact forces to be dissipated and/or redirected away from the cranium and brain within. Upon impact to the helmet, there are sequential stages of movement of the panels relative to each other, these movements initially being recoverable, but with sufficient vector forces the helmet undergoes structural changes in a pre-determined fashion, so that the recoverable and permanent movements cumulatively provide a protective 'crumple zone' or 'shear zone'."

U.S. Pat. No. 5,815,846 issued to Calonge describes "An impact resistant helmet assembly having a first material layer coupled to a second material layer so as to define a gas chamber therebetween which contains a quantity that provides impact dampening upon an impact force being applied to the helmet assembly. The helmet assembly further includes a containment layer disposed over the second material layer and structured to define a fluid chamber in which a quantity of fluid is disposed. The fluid includes a generally viscous gel structured to provide some resistance against disbursement from an impacted region of the fluid chamber to non-impacted regions of the fluid chamber, thereby further enhance the impact distribution and dampening of the impact force provided by the helmet assembly."

U.S. Pat. No. 5,956,777 issued to Popovich describes "A helmet for protecting a head by laterally displacing impact forces, said helmet comprising: a rigid inner shell formed as a single unit; a resilient spacing layer disposed outside of and in contact with said inner shell; and an articulated shell having a plurality of discrete rigid segments disposed outside of and in contact with said resilient spacing layer and a plurality of resilient members which couple adjacent ones of said rigid segments to one another."

U.S. Pat. No. 6,434,755 issued to Halstead describes a football helmet with liner sections of different thicknesses and densities. The thicker, softer sections would handle less intense impacts, crushing down until the thinner, harder sections take over to prevent bottoming out.

Still other ideas relate to using springs instead of crushable materials to manage the energy of an impact. Springs are typically associated with rebound, and energy stored by the spring is returned to the head. This may help in some instances, but can still cause significant neurological injury. Avoiding energy return to the head is a reason that non-rebounding materials are typically used.

Some of the protective gear mechanisms are not sufficiently biomechanically aware and are not sufficiently customized for particular areas of protection. These protective gear mechanisms also are not sufficiently active at the right time scales to avoid damage. For example, in many instances, materials like gels may only start to convert significant energy into heat after significant energy has been transferred to the brain. Similarly, structural deformation mechanisms may only break and absorb energy after a significant amount of energy has been transferred to the brain.

Current mechanisms are useful for particular circumstances but are limited in their ability to protect against numerous types of neurological damage. Consequently, an improved smart biomechanics aware and energy conscious protective gear mechanism is provided to protect against mechanical damage as well as neurological damage.

According to various embodiments, protective gear such as a helmet includes a container device to provide a structural mechanism for holding an energy and impact transformer. The design of this element could be a part of the smart energy conscious biomechanics aware design for protection. The energy and impact transformer includes a mechanism for the dissipation, transformation, absorption, redirection or force/energy at the right time scales (in some cases as small as a few milliseconds or hundreds of microseconds).

In particular embodiments, the container mechanism provides structure to allow use of an energy and impact transformer. The container mechanism may be two or three shells holding one or more layers of energy and impact transformer materials. That is, a multiple shell structure may have energy and impact transformer materials between adjacent shell layers. The shells may be designed to prevent direct penetration from any intruding or impeding object. In some examples, the outer shell may be associated with mechanisms for impact distribution, energy transformation, force dampening, and shear deflection and transformation. In some examples, the container mechanism can be constructed of materials such as polycarbonate, fiberglass, Kevlar, metal, alloys, combinations of materials, etc.

According to various embodiments, the energy and impact transformer provides a mechanism for the dissipation, transformation, absorption, and redirection of force and energy at the appropriate time scales. The energy and impact transformer may include a variety of elements. In some examples, a mechanical transformer element connects multiple shells associated with a container mechanism with mechanical structures or fluids that help transform the impact or shear forces on an outer shell into more benign forces or energy instead of transferring the impact or shear forces onto an inner shell.

In some examples, a mechanical transformer layer is provided between each pair of adjacent shells. The mechanical transform may use a shear truss-like structure connecting an outer shell and an inner shell that dampens any force or impact. In some examples, shear truss structure layers connect an outer shell to a middle shell and the middle shell to an inner shell. According to various embodiments, the middle shell or center shell may slide relative to the inner shell and reduce the movement and/or impact imparted on an outer shell. In particular embodiments, the outer shell may slide up to several centimeters relative to the middle shell. In particular embodiments, the material used for connecting the middle shell to the outer shell or the inner shell could be a material that absorbs/dissipates mechanical energy as thermal energy or transformational energy. The space between the outer shell, the middle shell, and the inner shell can be filled with absorptive/dissipative material such as fluids and gels.

According to various embodiments, the energy and impact transformer may also include an electro-rheological element. Different shells may be separated by an electro-rheological element with electric field dependent viscosity. The element may essentially stay solid most of the time. When there is stress/strain on an outer shell, the electric field is activated so that the viscosity changes depending on the level of stress/strain. Shear forces on an inner shell are reduced to minimize impact transmission.

In particular embodiments, the energy and impact transformer also includes a magneto-rheological element. Various shells may be separated by magneto rheological elements with magnetic field dependent viscosity. The element may essentially stay solid most of the time. When there is stress/strain on an outer shell, the magnetic field is activated so that the viscosity changes depending on the level of stress/strain. Shear forces on an inner shell are reduced to minimize impact transmission.

Electro-rheological and magneto-rheological elements may include smart fluids with properties that change in the presence of electric field or a magnetic field. Some smart fluids undergo changes in viscosity when a magnetic field is applied. For example, a smart fluid may change from a liquid to a gel when magnets line up to create a magnetic field. Smart fluids may react within milliseconds to reduce impact and shear forces between shells.

In other examples, foam and memory foam type elements may be included to absorb and distribute forces. In some examples, foam and memory foam type elements may reside beneath the inner shell. A magnetic suspension element may be used to actively or passively reduce external forces. An inner core and an outer core may be separated by magnets that resist each other, e.g. N-poles opposing each other. The inner and outer cores naturally would want to move apart, but are pulled together by elastic materials. When an outer shell is impact and the magnets are pushed closer, forces between the magnets increase through the air gap.

According to various embodiments, a concentric geodesic dome element includes a series of inner shells, each of which is a truss based geodesic dome, but connected to the outer geodesic through structural or fluidic mechanisms. This allows each geodesic structure to fully distribute its own shock load and transmit it in a uniform manner to the dome underneath. The sequence of geodesic structures and the separation by fluid provides uniform force distribution and/or dissipation that protects the inner most shell from these impacts.

In particular embodiments, a fluid/accordion element would separate an inner shell and an outer shell using an accordion with fluid/gel in between. This would allow shock from the outer core to be transmitted and distributed through the enclosed fluid uniformly while the accordion compresses to accommodate strain. A compressed fluid/piston/spring element could include piston/cylinder like elements with a compressed fluid in between that absorbs the impact energy while increasing the resistance to the applied force. The design could include additional mechanical elements like a spring to absorb/dissipate the energy.

In still other examples, a fiber element involves using a rippled outer shell with texture like that of a coconut. The outer shell may contain dense coconut fiber like elements that separate the inner core from the outer core. The shock can be absorbed by the outer core and the fibrous filling. Other elements may also be included in an inner core structure. In some examples, a thick stretchable gel filled bag wrapped around the inner shell could expand and contract in different areas to instantaneously transfer and distribute forces. The combination of the elasticity of a bag and the viscosity of the gel could provide for cushioning to absorb/dissipate external forces.

According to various embodiments, a container device includes multiple shells such as an outer shell, a middle shell, and an inner shell. The shells may be separated by energy and impact transformer mechanisms. In some examples, the shells and the energy and impact transformer mechanisms can be integrated or a shell can also operate as an energy and impact transformer.

Figure 2:
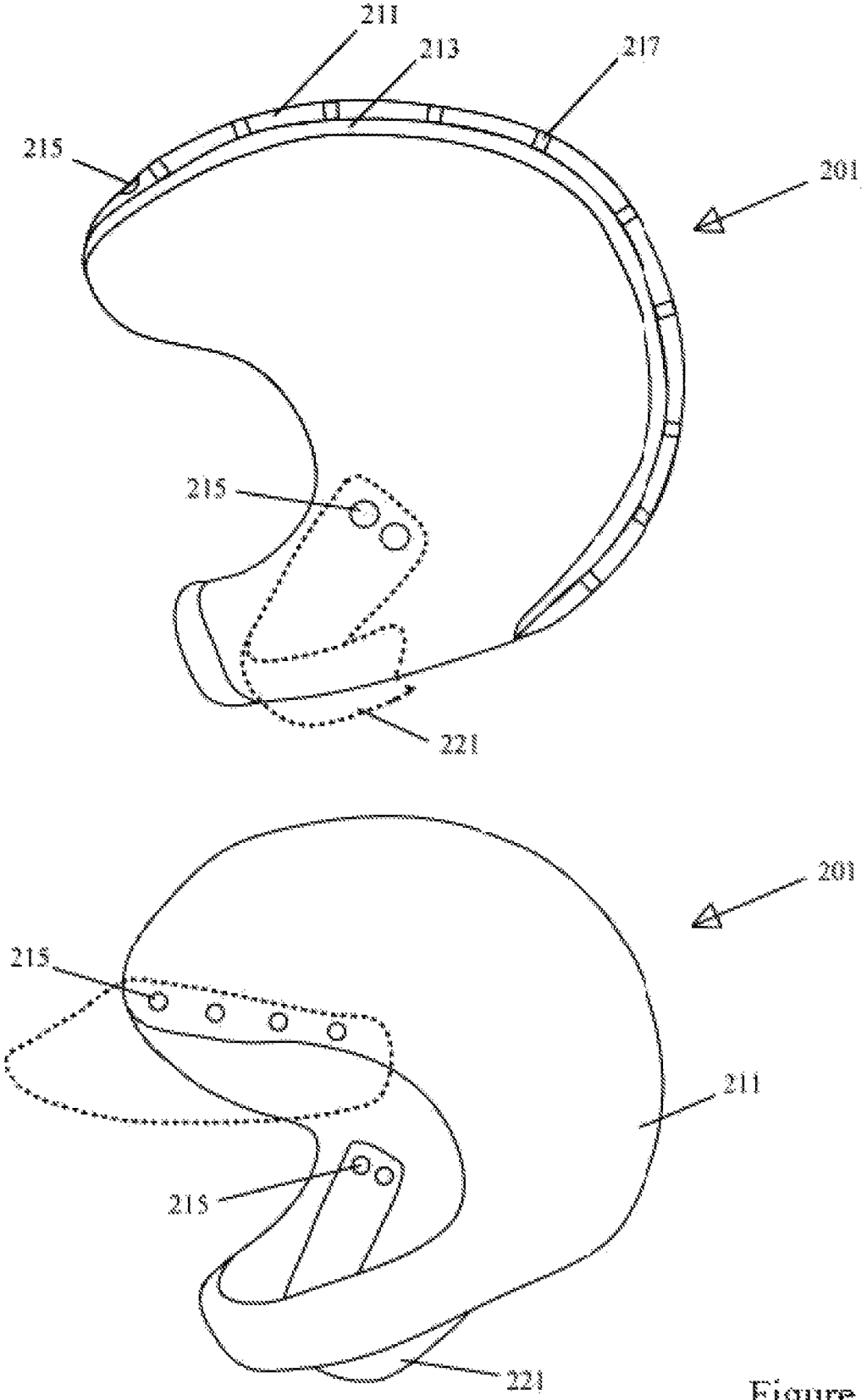
FIG. 2 illustrates one example of a piece of protective gear.

FIG. 2 illustrates one example of a particular piece of protective gear. Helmet 201 includes a shell layer 211 and a lining layer 213. The shell layer 211 includes attachment points 215 for a visor, chin bar, face guard, face cage, or face protection mechanism generally. In some examples, the shell layer 211 includes ridges 217 and/or air holes for breathability. The shell layer 211 may be constructed using plastics, resins, metal, composites, etc. In some instances, the shell layer 211 may be reinforced using fibers such as aramids. The shell layer 211 helps to distribute mechanical energy and prevent penetration. The shell layer 211 is typically made using lighter weight materials to prevent the helmet itself from causing injury.

According to various embodiments, a chin strap 221 is connected to the helmet to secure helmet positioning. The shell layer 211 is also sometimes referred to as a container or a casing. In many examples, the shell layer 211 covers a lining layer 213. The lining layer 213 may include lining materials, foam, and/or padding to absorb mechanical energy and enhance fit. A lining layer 213 may be connected to the shell layer 211 using a variety of attachment mechanisms such as glue or Velcro. According to various embodiments, the lining layer 213 is pre-molded to allow for enhanced fit and protection. According to various embodiments, the lining layer may vary, e.g. from 4 mm to 40 mm in thickness, depending on the type of activity a helmet is designed for. In some examples, custom foam may be injected into a fitted helmet to allow for personalized fit. In other examples, differently sized shell layers and lining layers may be provided for various activities and head sizes.

The shell layer 211 and lining layer 213 protect the skull nicely and have resulted in a dramatic reduction in skull fractures and bleeding between the skull and the brain (subdural and epidural hematomas). Military helmets use Kevlar to decrease penetrating injuries from bullets, shrapnel etc. Unfortunately, these approaches are not well designed to decrease direct forces and resultant coup-contra coup injuries that result in both contusions and compression-tension axon injuries. Furthermore, many helmets do not protect against rotational forces that are a core cause of a shear injury and resultant long-term neurological disability in civilian and military personnel. Although the introduction of Kevlar in military helmets has decreased mortality from penetrating head injuries, the survivors are often left with debilitating neurological deficits due to contusions and diffuse axonal injury.

Figure 3:
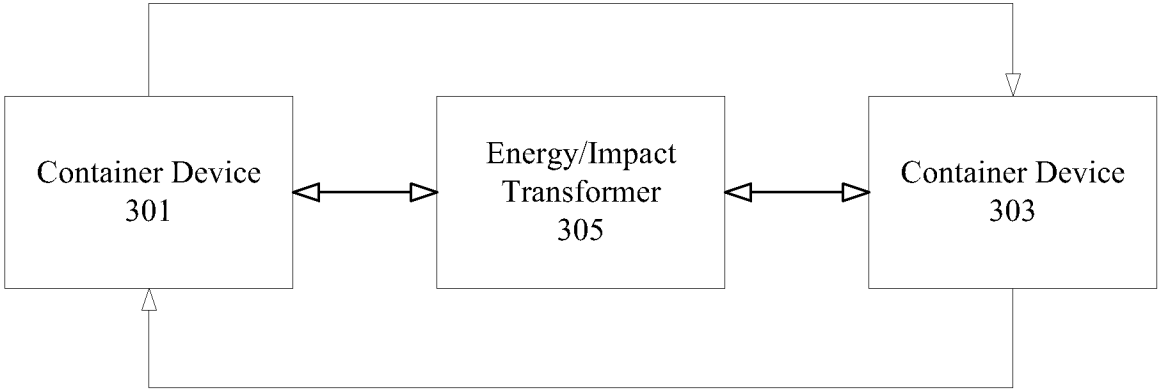
FIG. 3 illustrates one example of a container device system.

FIG. 3 illustrates one example of a container device system. According to various embodiments, protective gear includes multiple container devices 301 and 303. In particular embodiments, the multiple container devices are loosely interconnected shells holding an energy and impact transformer 305. The multiple container devices may be multiple plastic and/or resin shells. In some examples, the containers devices 301 and 303 may be connected only through the energy and impact transformer 305. In other examples, the container devices 301 and 303 may be loosely connected in a manner supplementing the connection by the energy and impact transformer 305.

According to various embodiments, the energy and impact transformer 305 may use a shear truss-like structure connecting the container 301 and container 303 to dampen any force or impact. In some examples, the energy and impact transformer 305 allows the container 301 to move or slide with respect to container 303. In some examples, up to several centimeters of relative movement is allowed by the energy and impact transformer 305.

In particular embodiments, the energy and impact transformer 305 could be a material that absorbs/dissipates mechanical energy as thermal energy or transformational energy and may include electro-rheological, magneto-rheological, foam, fluid, and/or gel materials.

Figure 4:
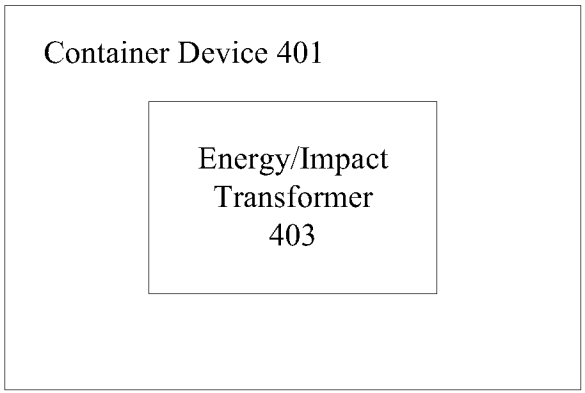
FIG. 4 illustrates another example of a container device system.

FIG. 4 illustrates another example of a container device system. Container 401 encloses energy and impact transformer 403. In some examples, multiple containers or multiple shells may not be necessary. The container may be constructed using plastic and/or resin. And may expand or contract with the application of force. The energy and impact transformer 403 may similarly expand or contract with the application of force. The energy and impact transformer 403 may receive and convert energy from physical impacts on a container 401.

Figure 5:
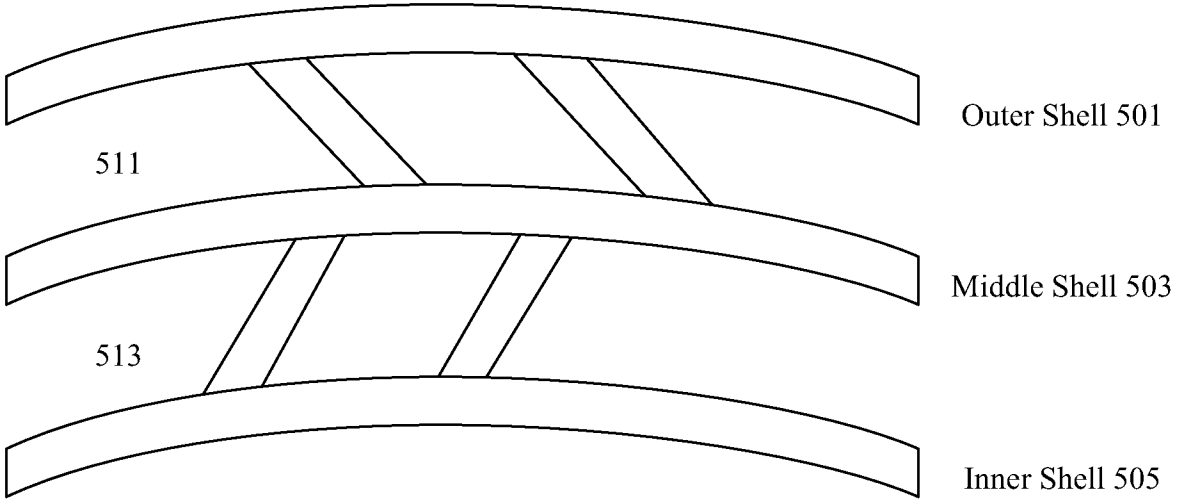
FIG. 5 illustrates one example of a multiple shell system.

FIG. 5 illustrates one example of a multiple shell system. An outer shell 501, a middle shell 503, and an inner shell 505 may hold energy and impact transformative layers 511 and 513 between them. Energy and impact transformer layer 511 residing between shells 501 and 503 may allow shell 501 to move and/or slide with respect to middle shell 503. By allowing sliding movements that convert potential head rotational forces into heat or transformation energy, shear forces can be significantly reduced.

Similarly, middle shell 503 can move and slide with respect to inner shell 505. In some examples, the amount of movement and/or sliding depends on the viscosity of fluid in the energy and impact transformer layers 511 and 513. The viscosity may change depending on electric field or voltage applied. In some other examples, the amount of movement and/or sliding depends on the materials and structures of materials in the energy and impact transformer layers 511 and 513.

According to various embodiments, when a force is applied to an outer shell 501, energy is transferred to an inner shell 505 through a suspended middle shell 503. The middle shell 503 shears relative to the top shell 501 and inner shell 505. In particular embodiments, the energy and impact transformer layers 511 and 513 may include thin elastomeric trusses between the shells in a comb structure. The energy and impact transformer layers 511 and 513 may also include energy dampening/absorbing fluids or devices.

According to various embodiments, a number of different physical structures can be used to form energy and impact transformer layers 511 and 513. In some examples, energy and impact transformer layer 511 includes a layer of upward or downward facing three dimensional conical structures separating outer shell 501 and middle shell 503. Energy and impact transformer layer 513 includes a layer of upward or downward facing conical structures separating middle shell 503 and inner shell 505. The conical structures in energy and impact transformer layer 511 and the conical structures in energy and impact transformer layer 513 may or may not be aligned. In some examples, the conical structures in layer 511 are misaligned with the conical structures in layer 513 to allow for improved shear force reduction.

In some examples, conical structures are designed to have a particular elastic range where the conical structures will return to the same structure after force applied is removed. The conical structures may also be designed to have a particular plastic range where the conical structure will permanently deform if sufficient rotational or shear force is applied. The deformation itself may dissipate energy but would necessitate replacement or repair of the protective gear.

Conical structures are effective in reducing shear, rotational, and impact forces applied to an outer shell 501. Conical structures reduce shear and rotational forces applied from a variety of different directions. According to various embodiments, conical structures in energy and impact transformer layers 511 are directed outwards with bases situated on middle shell 503 and inner shell 505 respectively. In some examples, structures in the energy and impact transformer layer may be variations of conical structures, including three dimensional pyramid structures and three dimensional parabolic structures. In still other examples, the structures may be cylinders.

Figure 6:
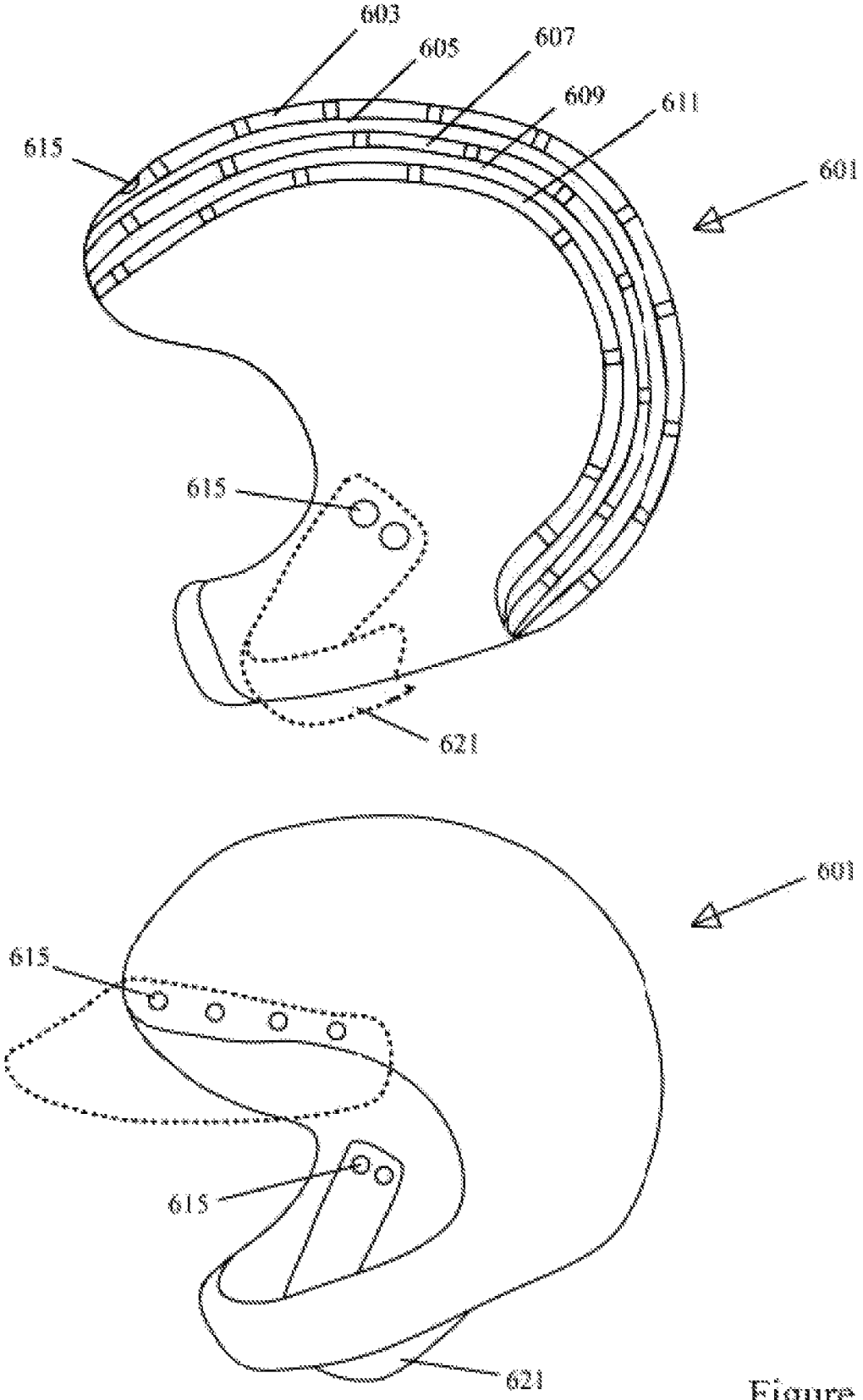
FIG. 6 illustrates one example of a multiple shell helmet.

FIG. 6 illustrates one example of a multiple shell helmet. According to various embodiments, helmet 601 includes an outer shell layer 603, an outer energy and impact transformer 605, a middle shell layer 607, an inner energy and impact transformer 609, and an inner shell layer 611. The helmet 601 may also include a lining layer within the inner shell layer 611. In particular embodiments, the inner shell layer 611 includes attachment points 615 for a chin strap for securing helmet 601. In particular embodiments, the outer shell layer 603 includes attachment points for a visor, chin bar, face guard, face cage, and/or face protection mechanism 615 generally. In some examples, the inner shell layer 611, middle shell layer 607, and outer shell layer 603 include ridges 617 and/or air holes for breathability. The outer shell layer 603, middle shell layer 607, and inner shell layer 611 may be constructed using plastics, resins, metal, composites, etc. In some instances, the outer shell layer 603, middle shell layer 607, and inner shell layer 611 may be reinforced using fibers such as aramids. The energy and impact transformer layers 605 and 609 can help distribute mechanical energy and shear forces so that less energy is imparted on the head.

According to various embodiments, a chin strap 621 is connected to the inner shell layer 611 to secure helmet positioning. The various shell layers are also sometimes referred to as containers or casings. In many examples, the inner shell layer 611 covers a lining layer (not shown). The lining layer may include lining materials, foam, and/or padding to absorb mechanical energy and enhance fit. A lining layer may be connected to the inner shell layer 611 using a variety of attachment mechanisms such as glue or Velcro. According to various embodiments, the lining layer is pre-molded to allow for enhanced fit and protection. According to various embodiments, the lining layer may vary, e.g. from 4 mm to 40 mm in thickness, depending on the type of activity a helmet is designed for. In some examples, custom foam may be injected into a fitted helmet to allow for personalized fit. In other examples, differently sized shell layers and lining layers may be provided for various activities and head sizes.

The middle shell layer 607 may only be indirectly connected to the inner shell layer 611 through energy and impact transformer 609. In particular embodiments, the middle shell layer 607 floats above inner shell layer 611. In other examples, the middle shell layer 607 may be loosely connected to the inner shell layer 611. In the same manner, outer shell layer 603 floats above middle shell layer 607 and may only be connected to the middle shell layer through energy and impact transformer 605. In other examples, the outer shell layer 603 may be loosely and flexibly connected to middle shell layer 607 and inner shell layer 611. The shell layers 603, 607, and 611 provide protection against penetrating forces while energy and impact transformer layers 605 and 609 provide protection against compression forces, shear forces, rotational forces, etc. According to various embodiments, energy and impact transformer layer 605 allows the outer shell 603 to move relative to the middle shell 607 and the energy and impact transformer layer 609 allows the outer shell 603 and the middle shell 607 to move relative to the inner shell 611. Compression, shear, rotation, impact, and/or other forces are absorbed, deflected, dissipated, etc., by the various layers.

According to various embodiments, the skull and brain are not only provided with protection against skull fractures, penetrating injuries, subdural and epidural hematomas, but also provided with some measure of protection against direct forces and resultant coup-contra coup injuries that result in both contusions and compression-tension axon injuries. The skull is also protected against rotational forces that are a core cause of a shear injury and resultant long-term neurological disability in civilian and military personnel.

In some examples, the energy and impact transformer layers 605 and 609 may include passive, semi-active, and active dampers. According to various embodiments, the outer shell 603, middle shell 607, and the inner shell 611 may vary in weight and strength. In some examples, the outer shell 603 has significantly more weight, strength, and structural integrity than the middle shell 607 and the inner shell 611. The outer shell 603 may be used to prevent penetrating forces, and consequently may be constructed using higher strength materials that may be more expensive or heavier.

In another aspect of the present invention, the helmet or protective gear provides a visual indication, an audio indication, or a combination of an audio and visual indication on the external surface of the outer shell when there is a mechanical force imparted on the helmet, specifically a shear force. One or more sensors are embedded in the helmet and detect when a shear force is imparted on the helmet. In other embodiments, the sensors can detect that there was a mechanical force on the helmet and also measure the energy of the force.

Sensors send signals to a visual means, such as an LED or buzzer, so that either someone not wearing the gear can see it or get an audio alert, the person wearing the gear can see it or hear it, or both the person wearing the gear and others can see or hear it. In some embodiments the visual indicator can stay on until manually turned off or can appear for a short duration and then go off automatically. In another embodiment, sensors send a signal to an audio means, such as a speaker, buzzer, or any suitable conventional audio device. For example, a buzzer that is very small and requires minimal power to make an audible sound may be used. The sound made can be persistent, that is, start when there is a mechanical force on the helmet and stay on until turned off or one that has a short duration. In yet another embodiment, there is both an audio and visual indication that there was a mechanical force of some degree on the helmet. For example, an LED light can go on and a buzzer or beeping sound can go off as well.

Figure 7:
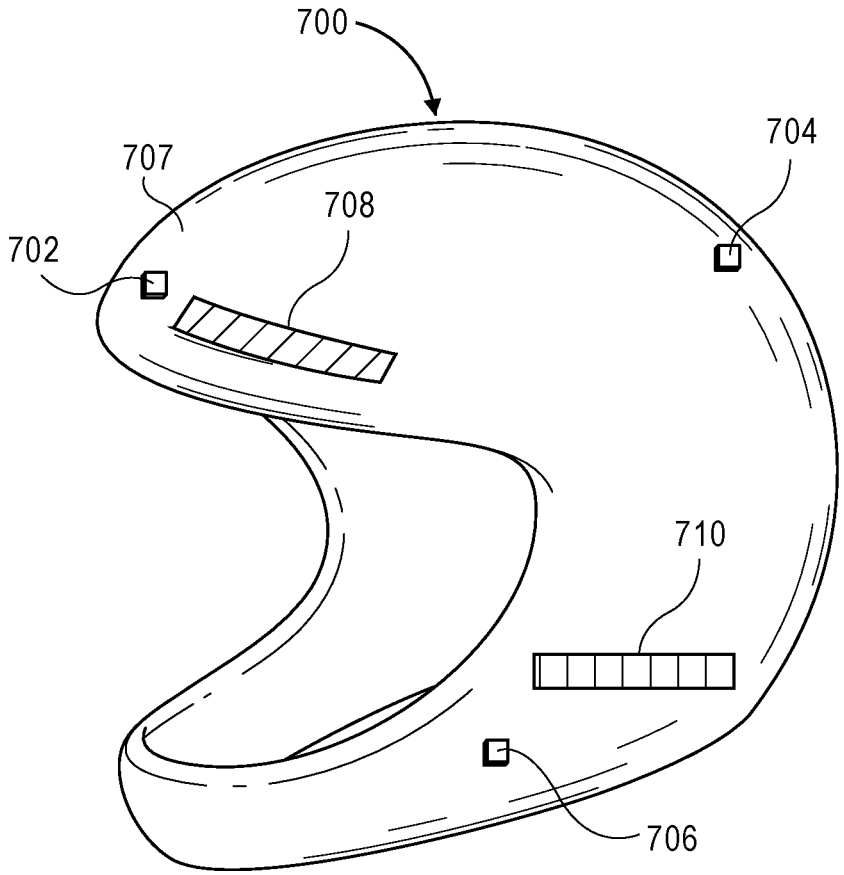
FIG. 7 illustrates a helmet having multiple shear force indicator elements.

FIG. 7 is an illustration of a helmet having multiple shear force indicators on the outer surface in accordance with one embodiment. A helmet 700 has an outer surface or skin 707. Indicators can be audio or visual or both. Some are shown as single components, such as modules 702, 704, and 706. As noted, these can be LEDs, buzzers, or any other type of indicator element. They can be placed at any suitable location on surface 707. An indicator can also be a series of illumination components or audio components such as 708 and 710. These longer components may be easier to notice from a distance.

Figure 8:
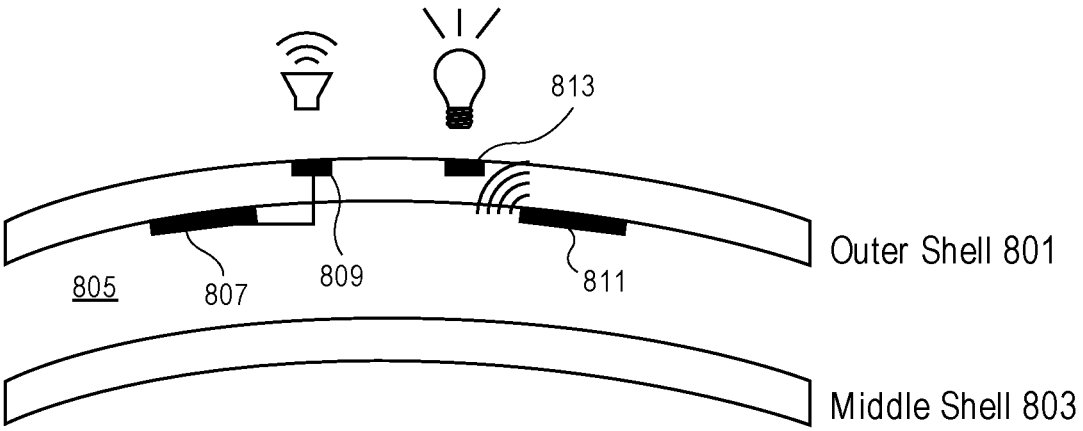
FIG. 8 illustrates a side view of a helmet showing locations of sensors and indicator elements.

FIG. 8 is a diagram showing placement and communication of sensors and indicator elements in accordance with one embodiment. An outer shell or layer 801 is separated from a middle layer 803 by an energy and impact transformer layer 805, as described above. Two shear force sensors are shown, sensor 807 and sensor 811. These can be any type of sensor. In one embodiment, a sensor, such as sensor 807 has a wired connection to an audio component 809 that is exposed at the outer surface of outer shell 801. This connection can also be wireless. In another embodiment, sensor 811 is connected wirelessly to an illumination component 813. As noted, the location of sensors 807 and 811 can vary and be in physical contact with various types of mechanisms for reducing or dissipating shear force impacts, as described below.

Figure 9:
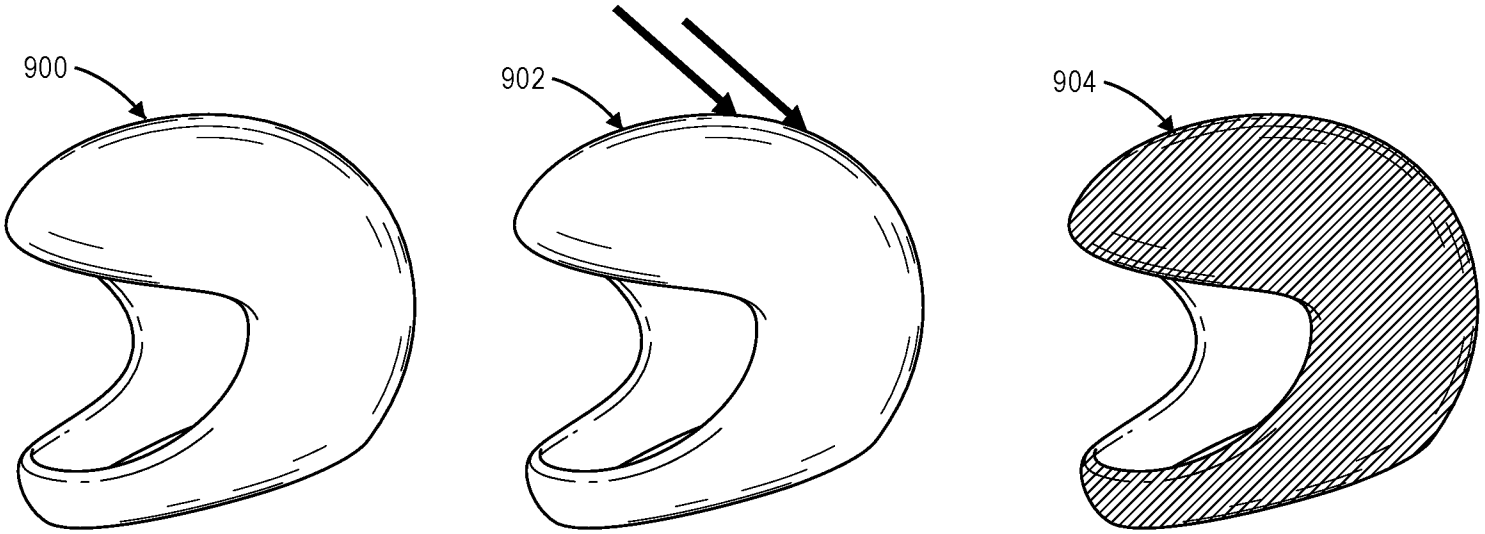
FIG. 9 illustrates a series of helmets showing a surface lining changing visual appearance when struck with a shear impact force.

In another embodiment, the external surface of the outer shell is made of or contains a material that changes color when impacted (i.e., dented, bent, twisted, or deformed in any way). This is shown in FIG. 9. The overall goal is to let the player (person wearing the helmet), and those who can see the player, that there was an impact on the helmet and that appropriate action may be required. The advantage with the audio signal is that the player and others around him, for example, in a football game, will know that a helmet was struck hard enough to stop play. The goal with all embodiments is to provide some type of indication that there was a shear or rotational force imparted on the helmet.

As described above, protective gear may have various layers and shells. In the described embodiment, there are three shells: outer, middle, and inner; and two layers, a first energy and impact transformation layer between the outer and middle shells and a second energy and impact transformation layer between the middle and inner shells. The helmet may have other components, such as a chin strap or inner shell lining or an inner lining layer, not directly relevant to the present invention. In another embodiment, there are two shells and one transformer layer between the shells. In the various embodiments, shear impact sensors, described below, and the audio and visual means are embedded, coupled to, or engaged with the layers and shells comprising the helmet.

In one embodiment, the sensors, which may be of one type or multiple, are inside the helmet structure. For example, a sensor can be attached to one of various means of absorbing, dissipating, or otherwise reducing shear force impact. These means and how one or more sensors can be attached to them are described below. First, various types of shear force sensors are described.

Sensors for detecting a shear impact on a surface can be generally categorized into four types: mechanical, thermal, optical, and electrical. Some of them, such as the thermal sensors, are not as sensitive to detecting or measuring impact forces as the electrical or optical ones, but are less expensive and more durable. For example, thermal shear sensors may be better suited for helmets used in high impact sports, but are not as precise as shear sensors that use deflecting beam principles which measure elongation or change in length (also referred to as the shear beam principle). There are also shear sensors that use pressure taps and mechanical balances.

All these sensors are generally available in micro-size housing, and could be potentially used in the multi-layer and multi-shell helmet configurations of the various embodiments. The sensor should be able to measure or detect shear forces from impacts striking any portion of the surface of the helmet and from any direction angle or degree. With a helmet, the surface referred to is the external or outside surface of the outer shell. It is important that the sensors be able to detect shear forces at nearly any point of the designated surface. In one embodiment, the sensitivity of the shear sensors can be adjusted so that, for example, only a relatively strong shear impact will be detected or, the opposite, in which a weaker shear impact force is detectable.

Other types of shear sensors include direct dual-axis, fluid shear stress sensors and MEMS sensors that directly measure shear stress in two axes. Related to these types of mechanical sensors are bi-axial, shear transducers based on strain gauges. Another type is referred to as an optical shearing force measurement device that indicates linear output change resulting from a shearing force. There are also flexible capacitive tactile sensor arrays for measuring shear forces using PDMS as a base material. Some of these types may not be suitable for all types of protective gears. Another type of sensor is a matrix-based tactile surface sensor that uses piezoresistance to measure actual contact shear force at an interface surface or point between two mating surfaces. The type of shear sensor used can be left to the designer and manufacturer of the protective gear.

In another embodiment, the protective gear contains or includes a material that provides a visual indication if there has been a shear impact. FIG. 9 shows a helmet at three different states having a special material lining or covering the external surface of outer shell that is not visually detectable. That is, the external skin of the outer shell does not stand out or have any distinguishing characteristics. It can be of any color, such as white as shown in helmet 900. A shear force impacts or strikes the surface of helmet 902 as indicated by the arrows. The force can be coming from any direction and at any angle. In one embodiment, the entire external skin of the helmet is lined or covered with the special material, described below. The color or other visual appearance of the outer shell changes after the impact. In one embodiment, as shown in helmet 904 the impact can affect the entire lining which causes the entire skin of the helmet to change color. In other embodiments, only the area of impact changes visual appearance. In general, there is a visual indication that there was a shear impact to the helmet.

The material used can be selected so that only impacts exceeding a certain threshold will cause a change in the color or appearance of the skin. Specifically, the outer or external surface of the outer shell of a helmet contains or is lined with a substance or material that acts as a skin to the outer shell that changes appearance, such as color or light refraction, when a shear impact or rotational impact force is imparted on it. In one embodiment, the outer shell is lined on its external surface with a polymer opal, a synthetic material that changes color when twisted or stretched. In another embodiment, the entire outer shell is comprised of the special material. In another embodiment, mechanocronic polymers are used. These materials that change reflection or color alteration, or can absorb light when there is mechanical action, such as a shear force. There are also materials referred to as mechanochromism (CAM) that changes color as more force is applied. Related to CAM are encryption mechanochromism (EM) which is a simple bi-layer system having a rigid, thin film and soft substrate. There are also nano-scale structural features to reflect colors of light. In another embodiment, plastic photonic Band Gap Bragg fibers in photonic textiles are used which can be characterized as visually interactive, that is, they change color or appearance proportionally to the amount of physical change, such as denting, stretching, twisting, and the like. Other possible materials that can be used to visually indicate a shear impact are structural color materials, such as conjugated polymers, chromatic polymers which display color change under stress (but are generally irreversible), and flexible, stretchable PDA composite fibers. In general, all the materials described here are able to provide visual indication of a shear impact force and, as such, they provide a means for detecting such a force but, typically, are not able to measure the force, with a few exceptions, such as the photonic textiles which are visually interactive.

As described above, a shear sensor detects an impact on the helmet outer shell. Once an impact is detected or sensed, the sensor sends a signal to an indicator component. This other component may be one of several types of indicators, such as LEDs, light bulbs, audio speakers, buzzers, and the like. For example, for visual indication, ultra-thin LEDs, micro LEDs, compact fluorescent, and other low power, low temperature light sources may be used. Other types of lights may also be used if suitable for the protective gear, such as halogen lights or incandescent bulbs.

Other indicators may include buzzers and speakers. For example, a sensor may send a signal to a micro buzzer that is magnetic or piezo transducer based and is housed in a compact package, for example, in the 4 mm to 9 mm range, and that have low profiles, such as 1.9 mm. The audio output from these types of components may be in the 65 dB to 100 dB range. They have compact footprints and have low profile packages which make them suitable for helmets and protective gear. In other embodiments, low profile, durable micro-speakers may be used that are 10-20 mm in diameter and are composed of Mylar cones or paper cones. Input power required for such speakers may be as low as 0.1 w. Regardless of the type of audio identification or alert used in the helmet, the audio indication should be loud enough for others or the person wearing the helmet to hear. They can be used in conjunction with visual indicators so that a light and a sound are made when there is a shear impact on the helmet. In other embodiments, these components may be directly coupled to the sensor such that the sensor contains the buzzer or LED, for instance. In the described embodiment, the sensor can have a wired or wireless connection with the visual/audio indicator. When the sensor sends a signal to the indicator, the one or more lights illuminate, an audio alert is emitted, or both.

In another embodiment, the sensor is able to not only detect that there was a shear impact on the helmet, but also measure the force of the impact. This measurement may be indicated by the lights and sound. In one example, the number of LEDs or the color of an LED may indicate if the force was low, medium, or high by lighting up one or multiple LEDs or lighting a yellow, green, or red LED to indicate the different impact forces.

As described above, an outer shell and a middle shell are separated by an energy and impact transformer layer. This layer may contain different types of structures to absorb mechanical impact on the helmet. It may also contain liquids, gels, foams, and other substances that are suitable for lessening the rotational or shear impact forces on the helmet from effecting the human head. The structures may be one of various mechanisms. These include concertinaed structures that are used to connect shell layers, these concertinaed structures can be expandable and collapsible, and can allow shell layers to move relative to each other when mechanical forces are imparted onto the outer shell layer. In some examples, the concertinaed structures can form accordion like structures that can expand or contract under various forces. In some embodiments, the concertinaed structures can be made of flexible materials having a range of properties. Depending on the application, the flexible materials can operate in elastic and/or plastic ranges. For instance, for minor impacts to the outer shell layer, the flexible materials may operate in the elastic range, such that the concertinaed structures return to their original positions after the helmet or protective gear returns to rest. In other examples, the flexible materials can be chosen to strain into the plastic range when an impact exceeds a certain force. In such cases, the concertinaed structures can absorb some of the energy imparted from the impact. Because the concertinaed structures would undergo plastic deformation in these cases, the concertinaed structures would need to be replaced before the helmet or protective gear could be used as effectively in the future.

In one embodiment, sensors can be attached to the concertinaed structures. When the structures are flexed or altered in any manner, it means that a shear force was imparted on the helmet and the sensor can detect this flexing. In this case, the sensor does not have to be a shear force sensor. It can be any type of sensor that detects a minor change in structure, such as micro compression of a concertinaed structure.

In another embodiment, a ball bearing layer is used to absorb or dissipate shear impact. An outer shell, a middle shell, and an inner shell may hold ball bearing layer and energy and impact transformer layer between them respectively. According to various embodiments, the outer shell includes multiple perforations to expose ball bearings housed in ball bearing layer. In particular embodiments, each ball bearing is individually housed on a layer of smaller bearings to allow multi-dimensional rotation. According to various embodiments, islands of ball bearings are housed in chambers to allow multi-dimensional rotation. In some examples, a single ball bearing may rotate on tens or hundreds of support ball bearings. In all these configurations a sensor may be coupled to or situated near or on a ball-bearing housing.

In another embodiment, devices are used to connect shell layers of the helmet, these devices are generally V-shaped configurations having bands that are made of flexible material such as rubber or other elastic substance. The bands are flexible to a degree and, as such, can flex thereby allowing shell layers to move relative to each other when mechanical forces or any type of impacts imparted onto an outer shell layer. Whatever the configuration of the device, the elasticity or flexibility allows it to contract, flex downward, or expand under various forces. Sensors can be attached to the V-shaped configuration.

In some embodiments, the shear protection devices of the present invention are made of a flexible material having a range of properties. Depending on the application or in what context the helmet will be used, the flexible material can operate in elastic and/or plastic ranges. For instance, for minor impacts to the outer shell layer, flexible materials comprising the device may operate in the elastic range, such that the V-shaped device returns to its original position after the helmet or protective gear returns to rest, i.e., immediately after the impact. In other examples, the flexible materials can be chosen so that they are able to strain into the plastic range when an impact, such as a shear force, exceeds a certain energy level. In such cases, the devices can absorb some of the energy imparted from the impact. Because the device would undergo plastic deformation in these cases, the V-shaped devices would need to be replaced before the helmet or protective gear could be used again effectively.

In short, the configuration and overall shape of the devices can vary widely without detracting from the objective of the device which is absorbing energy from various types of impacts to the helmet. As long as the end points are mounted to one surface and the vertex to an adjacent surface, with the connector bands at an angle between the end points and the vertex, the flexibility needed by the device to absorb energy from an impact can be achieved. In other embodiments, the end points and vertex may not be circular. The sensors can be attached to the vortexes or to the bands.

A mechanical impact on an outer surface forces a vertex downward which makes a band flex downward allowing the shell layers to move closer to each other or slide, thereby absorbing energy imparted from the impact. This allows the shell layers to move slightly in various ways, such as sliding, rotating, torqueing, and the like. In other embodiments, the angle (or slope) of the band may not be as great as the example shown. In addition, there may be another energy and impact layer between the middle shell and an inner shell that may contain one or more shear protection devices of the present invention to absorb or dissipate shear force, one form of mechanical energy, as thermal/transformational energy.

Although the foregoing invention has been described in some detail for purposes of clarity of understanding, it will be apparent that certain changes and modifications may be practiced within the scope of the appended claims. Therefore, the present embodiments are to be considered as illustrative and not restrictive and the invention is not to be limited to the details given herein, but may be modified within the scope and equivalents of the appended claims.

The invention claimed is:

1. A helmet comprising:

a first protective layer;

a second protective layer connected to the first protective layer by an energy and impact transformer layer operable to absorb energy from shear forces imparted on the first protective layer;

a shear force sensor for detecting a shear impact on the first protective layer; and a shear force indicator component in communication with said sensor, wherein the indicator component is activated when the shear force sensor detects an impact.

2. A helmet as recited in claim 1 wherein the shear force sensor is attached to an inside surface of the first protective layer.

3. A helmet as recited in claim 1 wherein the indicator component has one of an illumination element, an audio element, or a combined illumination and audio element.

4. A helmet as recited in claim 1 further comprising:

a shear force absorbing mechanism in the transformer layer wherein the sensor is in physical contact with said mechanism.

5. A helmet as recited in claim 4 wherein said mechanism is one of a concertained structure, a v-shaped elastic band component; a conical structure, a ball bearing mechanism, or an elastomeric structure of trusses.

6. A helmet as recited in claim 1 wherein the sensor detects shear impact on the helmet from any direction and at any point on the first protective layer.

7. A helmet as recited in claim 1 wherein the sensor is one of a mechanical-based sensor, a thermal sensor, an optical sensor, or an electrical sensor.

8. A helmet as recited in claim 1 wherein the sensor is able to detect a shear force and measure said shear force impact.

9. An interactive helmet comprising:

a protective structure including one or more protective layers and one or more energy absorbing layers;

a shear force absorbing mechanism in at least one energy absorbing layer of the one or more energy absorbing layers;

a sensor in physical contact with said shear force absorbing mechanism, wherein the sensor measures a mechanical impact on the protective structure; and an impact indicator element connected to the sensor that activates when the sensor detects a mechanical impact on the protective structure that exceeds a threshold force.

10. An interactive helmet as recited in claim 9 wherein the sensor is attached to an inside surface of a first protective layer.

11. An interactive helmet as recited in claim 9 wherein the impact indicator element is one of a light source, an audio source, or a combined light source and audio source.

12. An interactive helmet as recited in claim 9 wherein said mechanism is one of a concertained structure, a v-shaped elastic band component; a conical structure, a ball bearing mechanism, or an elastomeric structure of trusses.

13. An interactive helmet as recited in claim 10 wherein the sensor detects shear impact on the helmet from any direction and at any point on the first protective layer.

14. An interactive helmet as recited in claim 9 wherein the sensor is one of a mechanical-based sensor, a thermal sensor, an optical sensor, or an electrical sensor.

15. A helmet as recited in claim 9 wherein the sensor is able to detect a shear force and measure said shear force impact.

16. A helmet comprising:

a first protective shell having an outside surface and an inside surface;

a second protective shell connected to the first protective shell by an energy transformer layer; and an impact sensing material having a first visual appearance on the outside surface of the first protective shell wherein the impact sensing material changes to a second visual appearance when impacted by a shear force striking the helmet.

17. A helmet as recited in claim 16 wherein the impact sensing material is one of a polymer opal, mechanocronic polymers, encryption mechanocronic material, or a material having non-scale structural features.

18. A helmet as recited in claim 16 wherein the impact sensing material is a plastic photonic fiber in photonic textile wherein said textile is visually interactive.

19. A helmet as recited in claim 16 wherein the change from the first visual appearance to a second visual appearance occurs when the shear force is higher than a threshold energy level.

20. A helmet as recited in claim 16 wherein the second visual appearance is visible at an area of the shear force strike on the outside surface of the first protective shell.

21. A helmet as recited in claim 16 wherein the second visual appearance is a change in the color of the material or a change in the reflective lighting of the material.

* * * * *